US006363215B1

(12) United States Patent
Cafaro

(10) Patent No.: US 6,363,215 B1
(45) Date of Patent: Mar. 26, 2002

(54) HOT AIR AND LIGHT EMITTING CURLING BRUSH

(75) Inventor: Michael Cafaro, El Paso, TX (US)

(73) Assignee: Helen of Troy, L.P., El Paso, TX (US)

( * ) Notice: Subject to any disclaimer, the term of this patent is extended or adjusted under 35 U.S.C. 154(b) by 0 days.

(21) Appl. No.: 09/591,840

(22) Filed: Jun. 12, 2000

(51) Int. Cl.[7] ..... A45D 17/08

(52) U.S. Cl. ..... 392/384; 34/97; 219/220; 132/120; 132/118; 362/115

(58) Field of Search ..... 219/222, 226, 219/220; 392/384, 385, 380, 410, 409; 132/120, 121, 227, 229, 118; 362/109, 115, 119–120; 607/88, 90–91, 100, 109–110; 34/96–97

(56) References Cited

U.S. PATENT DOCUMENTS

| | | | | | |
|---|---|---|---|---|---|
| 847,872 | A | * | 3/1907 | Allen et al. | 34/96 |
| 1,228,669 | A | * | 6/1917 | Hardey | 607/88 |
| 1,393,635 | A | * | 10/1921 | Mondy | 132/118 |
| 2,397,757 | A | * | 4/1946 | Schwedersky | 362/115 |
| 2,688,971 | A | * | 9/1954 | Daniels et al. | 362/115 |
| 3,209,386 | A | * | 10/1965 | Weber | 132/118 |
| 3,949,765 | A | * | 4/1976 | Vallis | 34/96 |
| 4,197,608 | A | * | 4/1980 | Holley et al. | 132/118 |
| 4,323,761 | A | * | 4/1982 | Hubner | 392/385 |
| 4,602,143 | A | | 7/1986 | Mack et al. | |
| 4,939,340 | A | * | 7/1990 | Brill | 219/225 |
| 5,246,019 | A | * | 9/1993 | Godfrey et al. | 132/208 |
| 6,053,180 | A | * | 4/2000 | Kwan | 132/232 |
| 6,067,724 | A | * | 5/2000 | Depoyian | 34/97 |
| 6,285,828 | B1 | * | 9/2001 | Cafaro | 392/385 |

FOREIGN PATENT DOCUMENTS

| | | | | |
|---|---|---|---|---|
| FR | 513313 | * | 2/1921 | 132/118 |
| GB | 1522777 | * | 8/1978 | |

* cited by examiner

*Primary Examiner*—John A. Jeffery
(74) *Attorney, Agent, or Firm*—John E. Toupal; Harold G. Jarcho

(57) ABSTRACT

A hair curling brush comprises a convection heater and a barrel which encloses a halogen heating bulb. The barrel comprises a tube having both a plurality of bristles and a plurality of holes adjacent to the bristles. The heating bulb emits both visible light and infrared radiation. The barrel absorbs the infrared radiation but allows some visible light to escape through the holes. The brush includes a blower for forcing heated air from the barrel through the holes. The visible light glowing from the barrel provides an indicator of the heater's energization.

14 Claims, 8 Drawing Sheets

HOT AIR AND LIGHT EMITTING CURLING BRUSH

BACKGROUND OF THE INVENTION

The present invention relates to hair grooming appliances and more particularly to a hair curling brush having a halogen heating source and a blower.

Portable electric curling brushes are well known for setting curls in hair. A typical curling brush comprises a handle and a bristled curling barrel. The barrel is generally made of aluminum or some other metal having good thermal conductivity and is provided with some heating means. Typical heating means of prior curling brushes include electrical resistance and gas-burning heaters. Heat is transferred by conduction from the heated barrel to the hair.

Typically, the barrel is provided with bristles to form a brush. As hair is styled and groomed by brushing, tresses can be selectively captured by the bristles with a rotating motion of the brush and wound around the hot barrel. Maintaining the tresses around the barrel for several seconds sets the tresses into curls. It is often desirable but not possible to heat the barrel only while setting a curl into a tress of hair and cool it otherwise. It is also desirable but not possible to selectively inject hot air into hair either to dry wet hair while brushing or to improve and hasten curling.

Curling brushes differ in construction and function from curling irons, which comprise a clip for grasping the end of a hair tress against a heated barrel, but include no bristles. Although curling irons are adapted for setting curls similarly to curling brushes, they cannot provide the same styling and grooming functions which require bristles.

U.S. Pat. No. 4,602,143 to Mack et al discloses a hair curling iron that employs an infrared heating source within its curling barrel. The infrared heater provides heat in the form of radiation having a wavelength in the range of 1 to 7 microns. The barrel is transparent to such radiation to allow the radiation to pass through the barrel and penetrate the hair tresses. Although such an arrangement may function adequately in a curling iron, it is not readily adaptable to a curling brush as mentioned but not taught by Mack et al because the transparency of the barrel reduces its heat absorption and renders the barrel too cool. The simple addition of infrared-transparent bristles as suggested in Mack et al would not render his curling iron a curling brush as he has suggested because no provision is made for sufficient heating of the barrel. Additionally, the wavelength of the radiation emitted in the '143 device is not within the visible spectrum and does not provide any sort of visual indicator to warn the user that the device is energized and hot.

SUMMARY OF THE INVENTION

The present invention alleviates to a great extent the disadvantages of curling brushes of the prior art by providing a curling brush having a heat source comprised of a convection heater and a halogen bulb. The halogen bulb not only emits heat in the infrared spectrum, but also emits light in the visible spectrum. The brush barrel is opaque to and absorbent of the heat emitted by the bulb so that it can operate at a temperature sufficient for setting curls. The brush additionally includes a blower that serves to circulate heat evenly within the barrel and thereby provide a more evenly heated barrel surface. The blower also serves to force hot air from the barrel and inject it into the hair. It is found that halogen heat source heats the barrel more rapidly than those heat sources of the prior art, while the airflow from the blower reduces the barrel temperature almost instantaneously once the bulb is de-energized. Further, selective emission of the visible light emitted by the halogen bulb provides a more effective warning signal to the user when the device is operational and hot.

OBJECTS OF THE INVENTION

It is an object of the present invention to provide an improved hair curling brush.

It is an object of this invention to provide a curling brush whose barrel heats more rapidly when initially energized.

It is another object of this invention to provide a curling brush whose barrel cools more rapidly when de-energized.

It is another object of this invention to provide a curling brush whose barrel heats more evenly.

It is another object of the invention to provide a curling brush having a heat source which additionally emits visible light to warn the user that the barrel is electrically energized and hot.

It is another object of the invention to provide a curling brush that selectively comprises a hot barrel and emits hot air or comprises a cooler barrel and emits cooler air.

Other objects and advantages of the present invention will be readily apparent from the following description and drawings, which illustrate two embodiments of the invention.

DESCRIPTION OF THE PREFERRED EMBODIMENT

Figure 1:
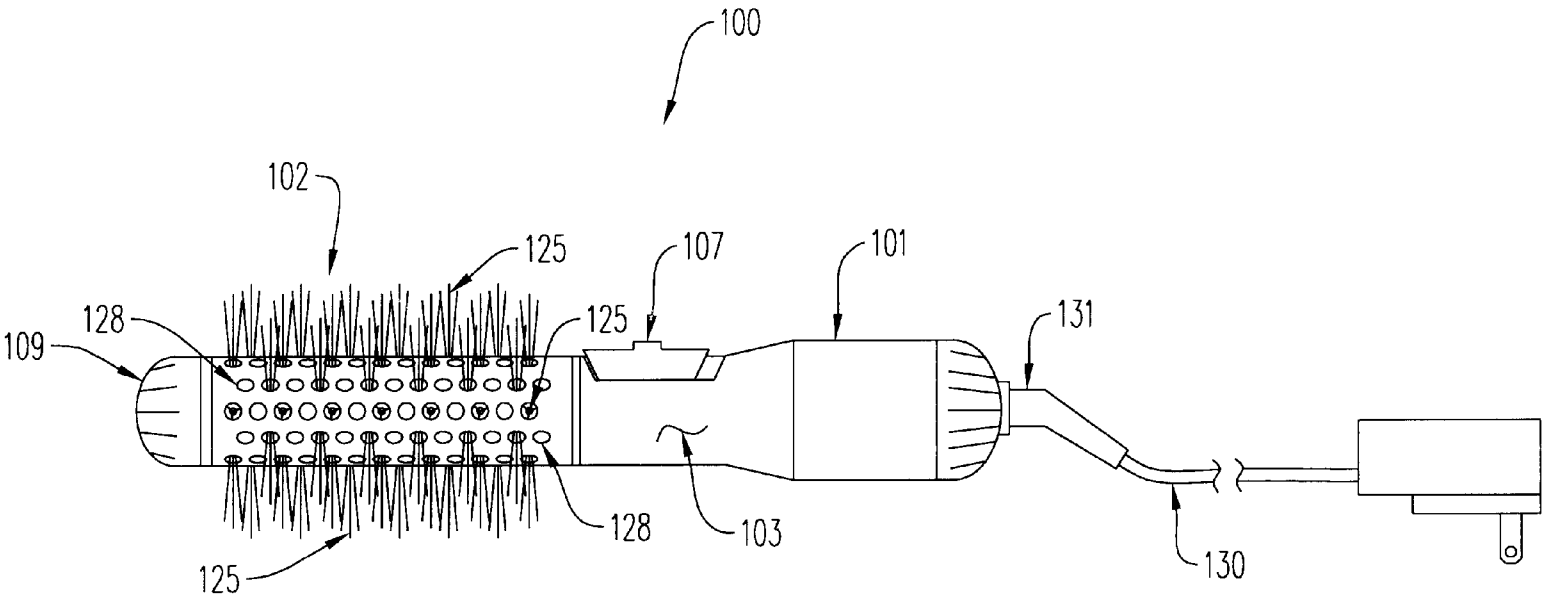
FIG. 1 is a side view of the preferred embodiment of a curling brush in accordance with the present invention.
Figures 2, 2A:
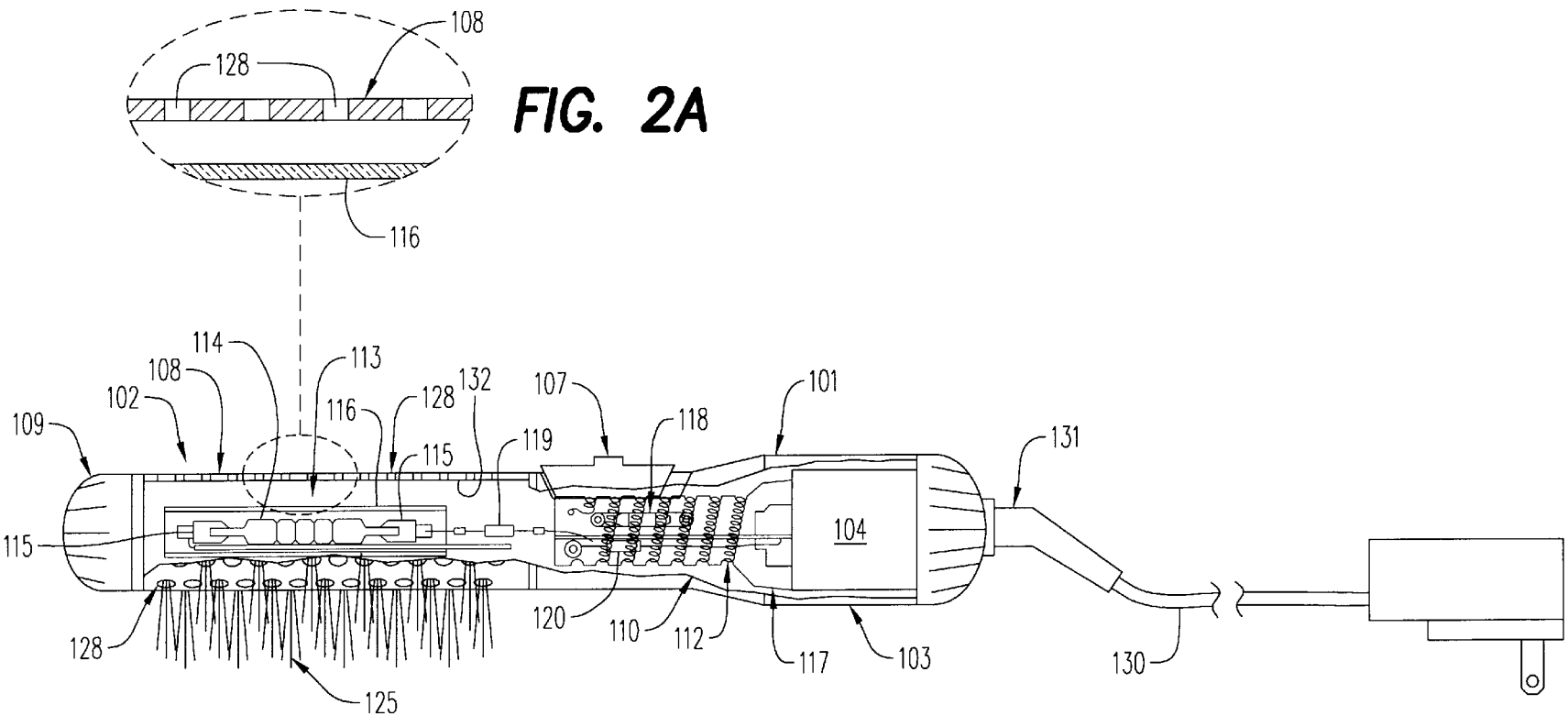
FIG. 2 is a partially sectioned side view of the curling brush of FIG. 1.
FIG. 2A is a detailed, enlarged section taken from FIG. 2.
Figure 3:
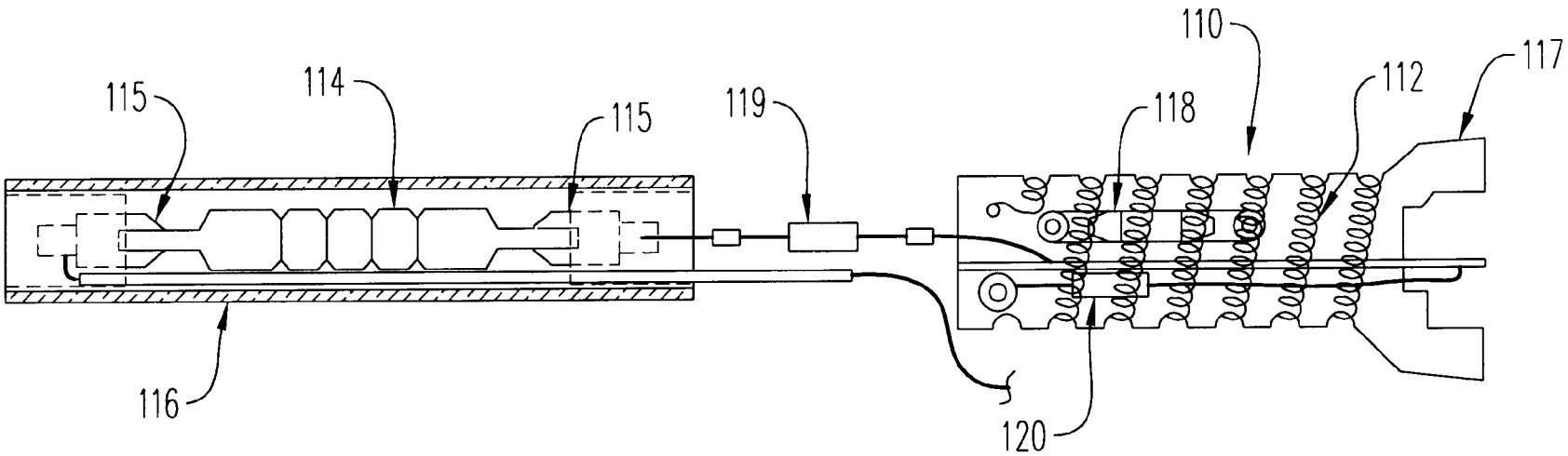
FIG. 3 is a side view of the heater sub-assembly of the curling brush of FIG. 1.
Figure 4A:
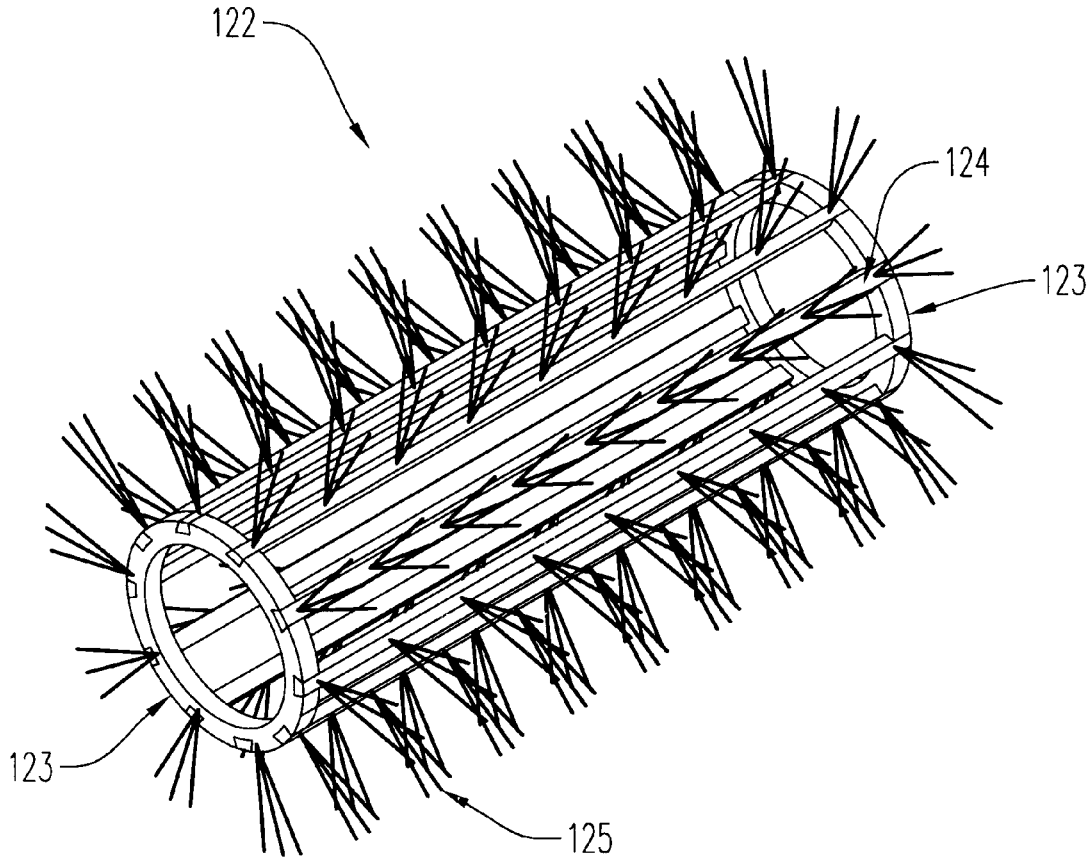
FIG. 4A is a perspective view of the bristle assembly of the curling brush of FIG. 1.
Figure 4B:
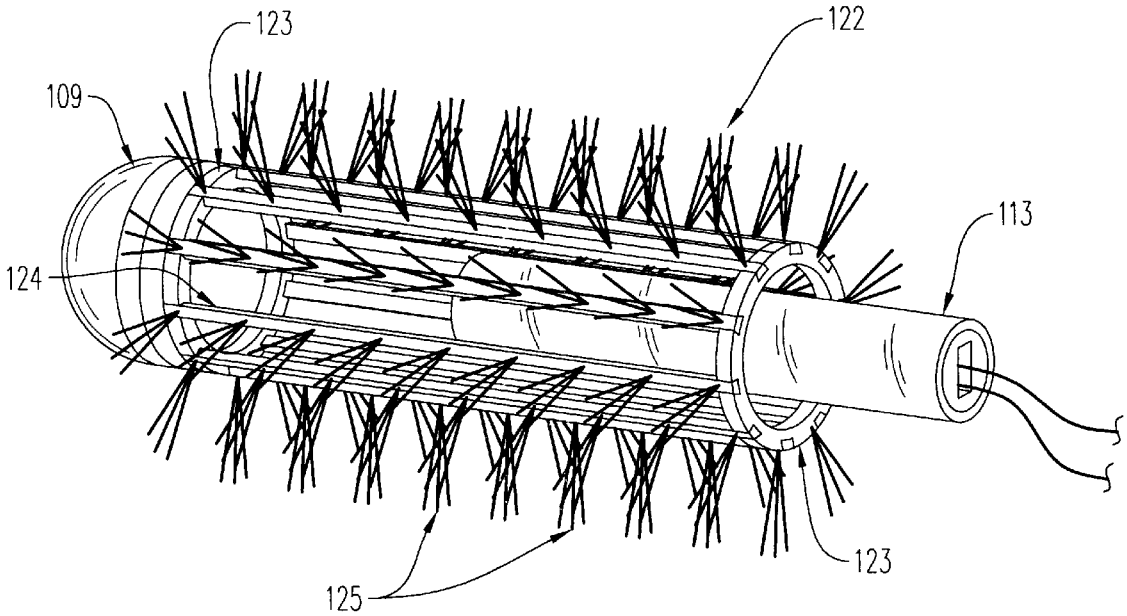
FIG. 4B is a perspective view of the joined bristle assembly, radiant heater assembly and end tip of the curling brush of FIG. 1.
Figure 4C:
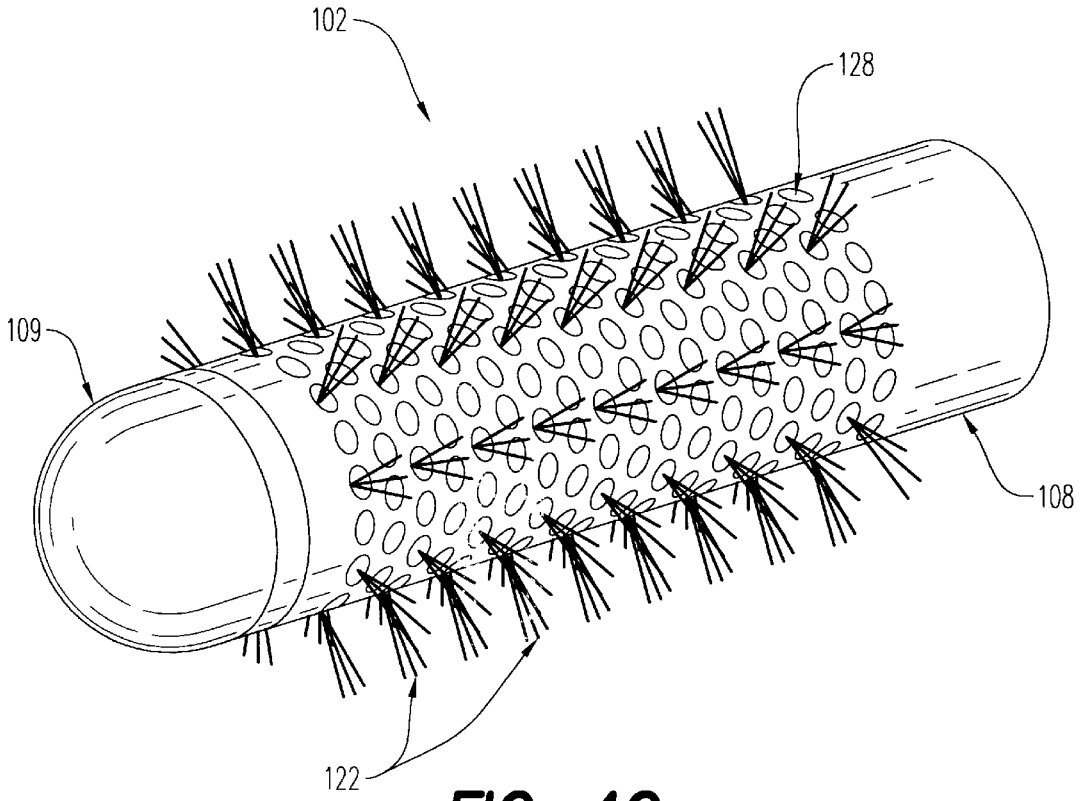
FIG. 4C is a perspective view of the bristled barrel of the curling brush of FIG. 1.
Figure 4D:
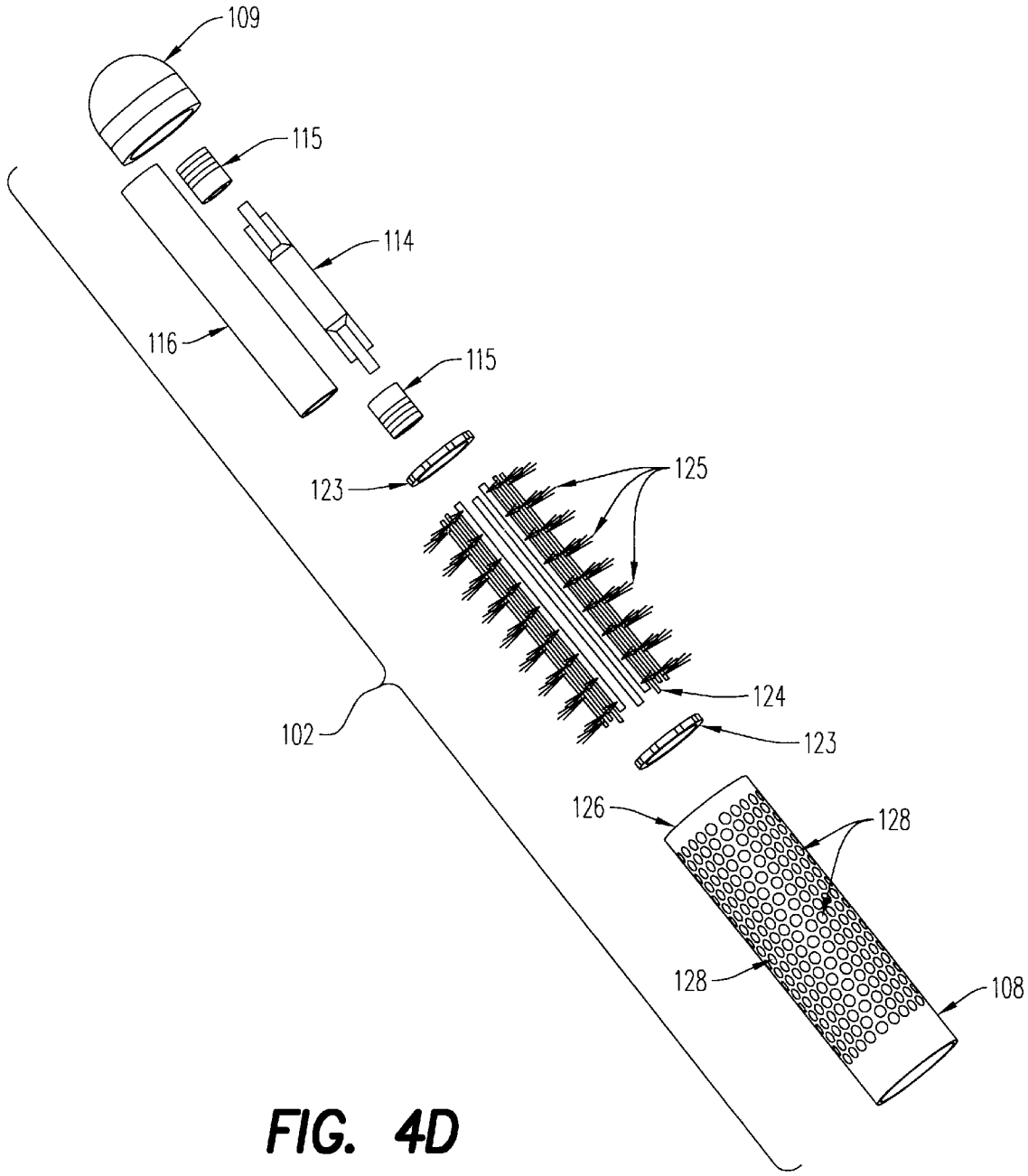
FIG. 4D is an exploded view of the bristled barrel of the curling brush of FIG. 1.

Referring now to FIGS. 1 through 4D there is shown a curling brush 100, in accordance with the preferred embodiment of the invention. The curling brush comprises a housing formed by a handle portion 101 and a barrel portion 102.

Handle portion 101 comprises a housing 103 molded of plastic. The housing encases a motorized blower 104 and convection heater assembly 110. The handle portion further includes a mode switch 107 having at least an "off" position, a "high" position, and a "low" position, and being operatively connected to the control circuitry. The control circuitry 105 is shown schematically in FIG. 5.

Barrel portion 102 comprises a hollow metal tube 108 extending longitudinally from the handle portion and an end tip 109 attached at the end distant from the handle portion.

Radiant heater assembly 113 is contained within the tube and electrically connected to the control circuitry. The radiant heater portion includes halogen heating bulb 114 captured coaxially within two ceramic end caps 115 and surrounded by a silicon sleeve 116 that is transparent to both visual light and infrared radiation.

The convection heating assembly 110 includes heating coil 112 wound around mica support 117, which also supports a thermostat 118, a first thermal fuse 119, and a second thermal fuse 120. The thermostat 118 is electrically connected in series with the heating coil and is configured to energize the coil when the thermostat senses a temperature below a first predetermined level. The first thermal fuse 119 is electrically connected in series with the halogen bulb and is configured to de-energize the bulb when the fuse senses a temperature above a higher second predetermined level. The second thermal fuse is electrically connected in series with the remainder of the control circuit and is configured to de-energize the entire appliance when it senses a temperature above an even higher third predetermined level.

The tube of the barrel portion is perforated with rows of holes 128 to allow some air to flow from the barrel when the blower is energized. Bristle assembly 122 is longitudinally positioned within the tube and comprises two slotted end ring supports 123 that capture the four bristled strips 124. The bristle assembly is fitted within the tube so that bristles 125 project through some of the holes, but the remaining majority of holes remain open to allow air to pass through. The bristle assembly is captured within the tube by end tip 109, which is crimped to the distal end 126 of the tube 108, to form the barrel into the brush. The bristles 125 are made of a semi-rigid material having a high temperature tolerance. The rows of holes are spaced around the tube between adjacent bristle strips to allow the air to flow radially from the brush.

Electrical power is supplied to the handle portion through power supply cord 130 that is rotatable at swivel connection 131 to eliminate tangling. When the mode switch is shifted to "high", the heating coil, halogen bulb, and blower are fully energized. The halogen bulb instantly emits infrared radiation and visible light that pass through the silicone sleeve and strike the inner wall 132 of tube 108. Most of the infrared radiation is absorbed by the tube and converted to heat and the temperature of the tube rapidly rises. A sufficient amount of the visible light escapes through the holes of the tube to be readily seen by the user and provide an instant indication that the bulb is energized and that invisible infrared heat is also being produced. Airflow induced by the blower flows over the heating portion and the bulb and circulates within the hollow tube, passing over the thermostat and thermal fuses, and escapes through the holes and through the bristles at an outflow temperature sufficient to dry or condition hair. The hot air circulating within the tube assists to distribute the heat being produced at the tube wall and help to maintain a more even temperature distribution along the length of the tube, and to avoid hot spots close to the bulb. Provided that the thermostat continues to sense a temperature below the aforesaid predetermined first temperature level, it continues to energize the heater and thereby maintain the surface temperature of the tube at a level sufficient to curl hair there-around. During this mode, with the barrel being so hot and emitting such hot air, the brush is ideal for hot-brushing and styling hair, and for curling hair tresses. If an abnormal condition occurs, say for instance the blockage of holes in the tube or a thermostat failure, which causes the tube's internal temperature to rise above the aforesaid second predetermined temperature level, the first thermal fuse will open to permanently disable the bulb. This is a critical safety feature of the invention. Alternately, if such an abnormal condition has occurred and the first thermal fuse has not opened, allowing the tube's internal temperature to rise above the aforesaid third predetermined temperature level, the second thermal fuse will open to permanently disable the appliance. This is a back-up safety feature of the invention.

When the mode switch is shifted to "low", the wattage level of the halogen bulb and heating coil are reduced, but the blower remains fully energized. Enough visible light continues to escape to provide an indication, but the same airflow passing over the cooler lamp and coil is now sufficient to cool the tube and the out-flowing air to a temperature sufficiently cool to instantly set the curled hair.

Figure 5:
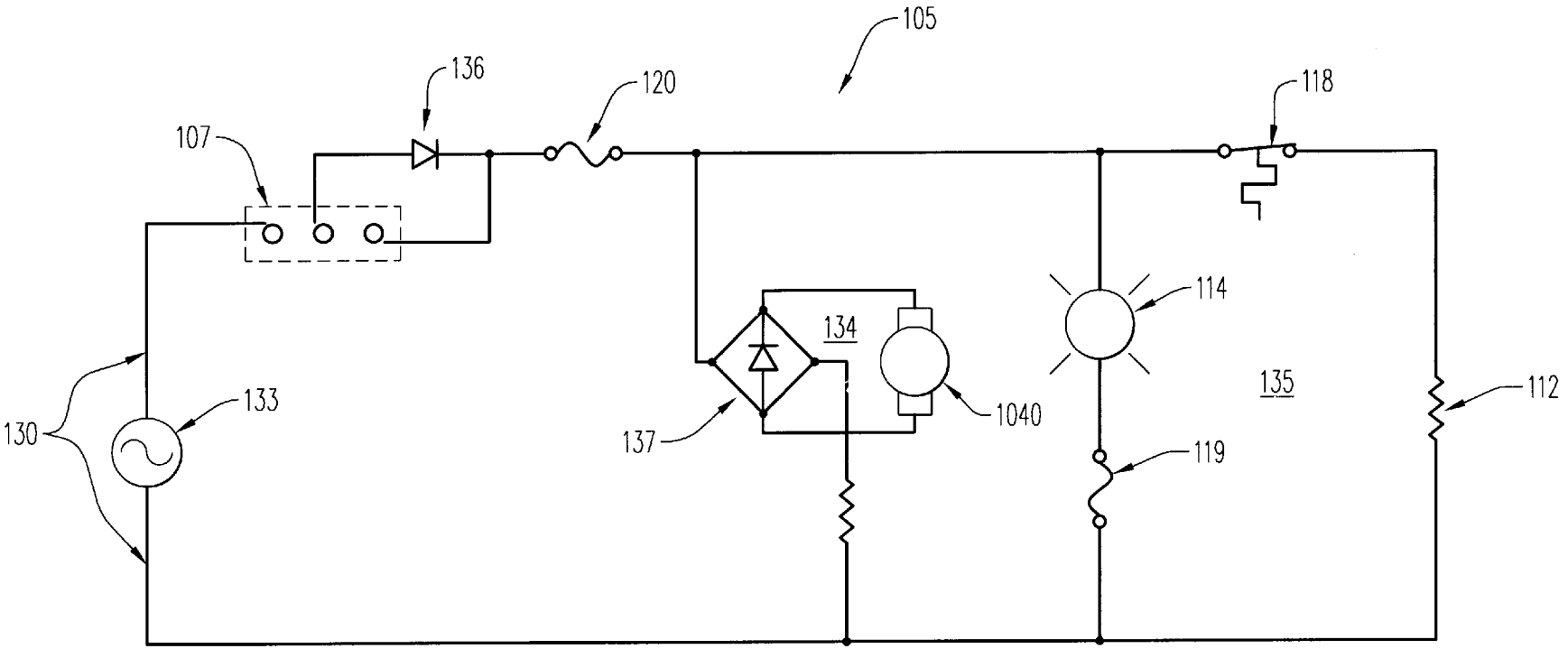
FIG. 5 is a schematic diagram of the electric circuitry of the curling brush of FIG. 1.

Referring now to FIG. 5, there is shown a schematic diagram of control circuit 105 used in the preferred embodiment to control the operation of the curling brush. It will be noted that certain components shown, such as the motor, mode switch, thermostat, bulb, and thermal fuses are those already described and physically mounted according to the prior description, being shown only schematically in this diagram. The remaining components shown are part of the convection heater assembly that is encased within the handle housing, and is not shown.

The circuit is provided with power from a standard 120 VAC supply 133. Mode switch 107 is adapted in the "high" position for providing that 120 VAC directly to the blower sub-circuit 134 and the heating sub-circuit 135. In the "low" position, the switch connects to the motor and heating sub-circuits through a diode 136, which halves the effective power available to the heating circuit. The direct-current blower 104 is connected to the supply voltage through a rectifier 137, which is matched with the diode so that it maintains full power despite the switch's position.

In operation, the motor is energized to cause blower 104 to circulate air through barrel past the energized heating coil 112 and halogen heating bulb 114. The blower serves to circulate the heated air over the thermostat 118, first thermal fuse 119, and second thermal fuse 120.

In normal operation on "high", it is found that the barrel heats to its desired curling temperature almost instantaneously after the bulb is energized, and that the barrel cools to its desired setting temperature almost instantaneously after the switch is moved to the "low" position.

It will be obvious to those skilled in the art that numerous modifications may be made to the invention and that the above disclosure represents only the preferred of many possible embodiments. The scope of the invention should not be limited therefore by the above embodiment, but only by the limitations of the following claims.

What is claimed is:

1. A curling brush comprising:

a housing retaining heating means for providing radiant heat, convection heat and visible light, said housing comprising a radiation absorbent tube for grooming hair and disposed to receive radiant heat from said heating means, and said tube defining a plurality of spaced apart openings for emitting convection heat and visible light provided by said heating means; and said heater means comprising a convection heater for producing said convection heat, a blower for forcing said convection heat out of said openings, and a radiant heater for producing said radiant heat; and a plurality of bristles projecting from said tube.

2. The brush of claim 1, wherein said heating means has a low power level for emitting less heat and a high power level for emitting more heat, and wherein said air current flowing from said tube is below a first certain temperature level during said lower power level and above said first certain temperature level during said high power level.

3. The brush of claim 1 wherein said heating means has a lower power level for emitting less heat and a high power level for emitting more heat and wherein said tube is below a first certain temperature level during said low power level and above said first certain temperature level during said high power level.

4. The brush of claim 3 wherein said air current flowing from said tube is below a second certain temperature level during said low power level and above said second certain temperature level during said high power level.

5. The brush of claim 1 wherein said visible light is emitted from said tube through said openings, when said heater is energized.

6. The brush of claim 5 wherein said heating means has a low power level for emitting less heat and a high power level for emitting more heat, and wherein said air current flowing from said tube is below a first certain temperature level during said low power level and above said first certain temperature level during said high power level.

7. The brush of claim 5 wherein said heating means has a low power level for emitting less heat and a high power level for emitting more heat and wherein said tube is below a first certain temperature level during said low power level and above said first certain temperature level during said high power level.

8. The brush of claim 7 wherein said air current flowing from said tube is below a second certain temperature level during said low power level and above said second certain temperature level during said high power level.

9. The brush of claim 1 wherein said radiant heater comprises a halogen lamp and said convection heater is a heating coil.

10. The brush of claim 1 including support means mounted in said tube and supporting said bristles which project through at least some of said openings.

11. The brush of claim 10 wherein at least some of said openings are free of said bristles so as to transmit said visible light.

12. The brush of claim 11 wherein said housing further comprises a handle portion joined to said tube and retaining said convection heater and said blower.

13. A curling brush according to claim 12 wherein said tube retains said radiant heater.

14. The brush of claim 1 wherein said radiant heater comprises a halogen lamp and said convection heater is a heating coil.

* * * * *